US010524568B2

(12) United States Patent
Lin

(10) Patent No.: US 10,524,568 B2
(45) **Date of Patent: *Jan. 7, 2020**

(54) ADJUSTABLE DESK WITH COMBINATIVE WORK SURFACE ASSEMBLIES

(71) Applicants: Hi-Max Innovation Co., Ltd., Taichung (TW); Yi-Chen Tseng, Taichung (TW)

(72) Inventor: Jhih-Fan Lin, Taichung (TW)

(73) Assignees: Hi-Max Innovation Co., Ltd., Taichung (TW); Yi-Chen Tseng, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/906,647

(22) Filed: Feb. 27, 2018

(65) Prior Publication Data

US 2019/0261772 A1 Aug. 29, 2019

(51) Int. Cl.
*A47B 87/00* (2006.01)
*A47B 21/02* (2006.01)
*A47B 9/20* (2006.01)

(52) U.S. Cl.
CPC ..... *A47B 87/002* (2013.01); *A47B 9/20* (2013.01); *A47B 21/02* (2013.01)

(58) Field of Classification Search
CPC ..... A47B 87/002; A47B 9/20; A47B 21/02; A47B 21/00; A47B 21/06; A47B 3/06; A47B 2200/0026; A47B 2200/0066; A47B 2200/00; A47B 220/0046; A47B 2220/0046
USPC ..... 108/106–108, 147, 59, 64; 248/120, 248/188.1, 188, 188.9, 188.8, 677, 683, 248/362
See application file for complete search history.

(56) References Cited

U.S. PATENT DOCUMENTS 616,296 A * 12/1898 Dennis
2,890,087 A * 6/1959 Stevens ..... A47B 1/04 108/64
4,383,486 A * 5/1983 Reineman ..... A47B 9/00 108/10
5,615,620 A * 4/1997 Owen ..... A47B 23/04 108/150
5,752,449 A * 5/1998 Simon ..... A47B 9/00 108/153.1
6,135,032 A * 10/2000 Ko ..... A47B 9/083 108/147.21
6,431,319 B1 8/2002 Myers et al.
7,086,632 B2 * 8/2006 Hsieh ..... G10H 1/32 108/147
8,001,909 B2 8/2011 Overgaard
(Continued)

*Primary Examiner* — Janet M Wilkens
(74) *Attorney, Agent, or Firm* — Wang Law Firm, Inc.

(57) ABSTRACT

A desk includes a base and a work surface assembly mounted on the base. The work surface assembly has a board and a leg having opposite ends connected to the board and the base. The leg has an inclined section and a straight section, and the board has a first end and a second end opposite to the first end. A distance between the first end of the board and the straight section of the leg is greater than that of between the second end of the board and the straight section of the leg. The boards of the work surface assemblies are arranged in a row or two rows of a matrix. Therefore, the work surface assemblies are combinative to be mounted on the base to have various layouts of the boards.

4 Claims, 10 Drawing Sheets

(56) References Cited

U.S. PATENT DOCUMENTS

| | | | | |
|---|---|---|---|---|
| 8,960,105 | B1 * | 2/2015 | Lira | A47B 23/04 108/10 |
| 10,271,642 | B1 * | 4/2019 | Lin | A47B 13/088 |
| 2007/0278834 | A1 * | 12/2007 | Kielland | A47B 21/00 297/170 |
| 2008/0289545 | A1 * | 11/2008 | Picchio | A47B 9/04 108/106 |
| 2013/0256611 | A1 | 10/2013 | Ruth sen. | |

* cited by examiner

ADJUSTABLE DESK WITH COMBINATIVE WORK SURFACE ASSEMBLIES

BACKGROUND OF THE INVENTION

1. Technical Field

The present invention relates to a desk or a table, and more particularly to a height adjustable desk with combinative work surface assemblies.

2. Description of Related Art

Typically, a conventional height adjustable desk has a work surface with a telescopic leg. For example, US 20130256611 and U.S. Pat. No. 6,431,319 provided a height adjustable desk with a scissor for lifting a work surface. U.S. Pat. No. 8,001,909 provided a lifting column for lifting a work surface.

These conventional height adjustable desks only provided a height adjustable work surface. There is no such a prior art, which have plural of adjustable work surfaces to be selected for combination. It may be a solution to have several desks for connection in a matrix. However, it takes a large space for sure. Besides, the complex structure may make it difficult to sit.

BRIEF SUMMARY OF THE INVENTION

In view of the above, the primary objective of the present invention is to provide a desk with combinative work surface assemblies, which has simple structure and takes less space.

In order to achieve the objective of the present invention, a desk includes a base and a work surface assembly mounted on the base. The work surface assembly has a board and a leg having opposite ends connected to the board and the base. The leg has an inclined section and a straight section, and the board has a first end and a second end opposite to the first end. A distance between the first end of the board and the straight section of the leg is greater than that of between the second end of the board and the straight section of the leg.

The present invention further provides a plurality of work surface assemblies to be mounted on the base, and the work surface assemblies are arranged in a matrix.

In an embodiment, the inclined sections of the legs of the work surface assemblies lean to the same direction, so that the boards are arranged in a row. In another embodiment, the inclined sections of the legs of the work surface assemblies lean to opposite directions, so that the boards are arranged in two rows.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
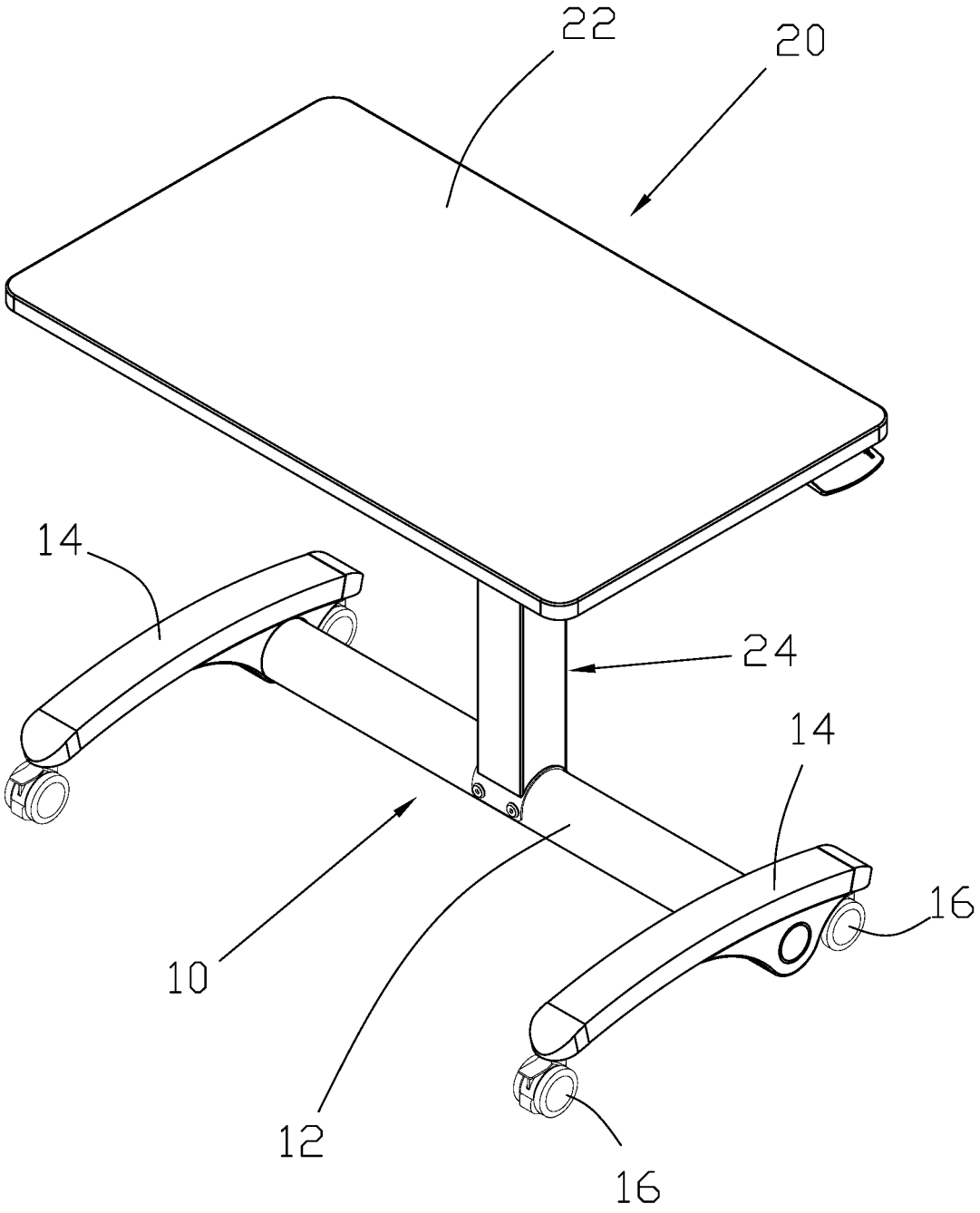
FIG. 1 is a perspective view of a preferred embodiment of the present invention.

FIG. 1 show a height adjustable desk of the preferred embodiment of the present invention, includes a base 10 and a work surface assembly 20. The base 10 includes a shaft 12 and two stands 14 connected to opposite ends of the shaft 12. Each of the stands 14 is provided with two wheels 16. The work surface assembly 20 includes a leg 24 and a board 22 connected to an end of the leg 24. The leg 24 has an opposite end connected to the shaft 12 of the base 10.

Figure 2:
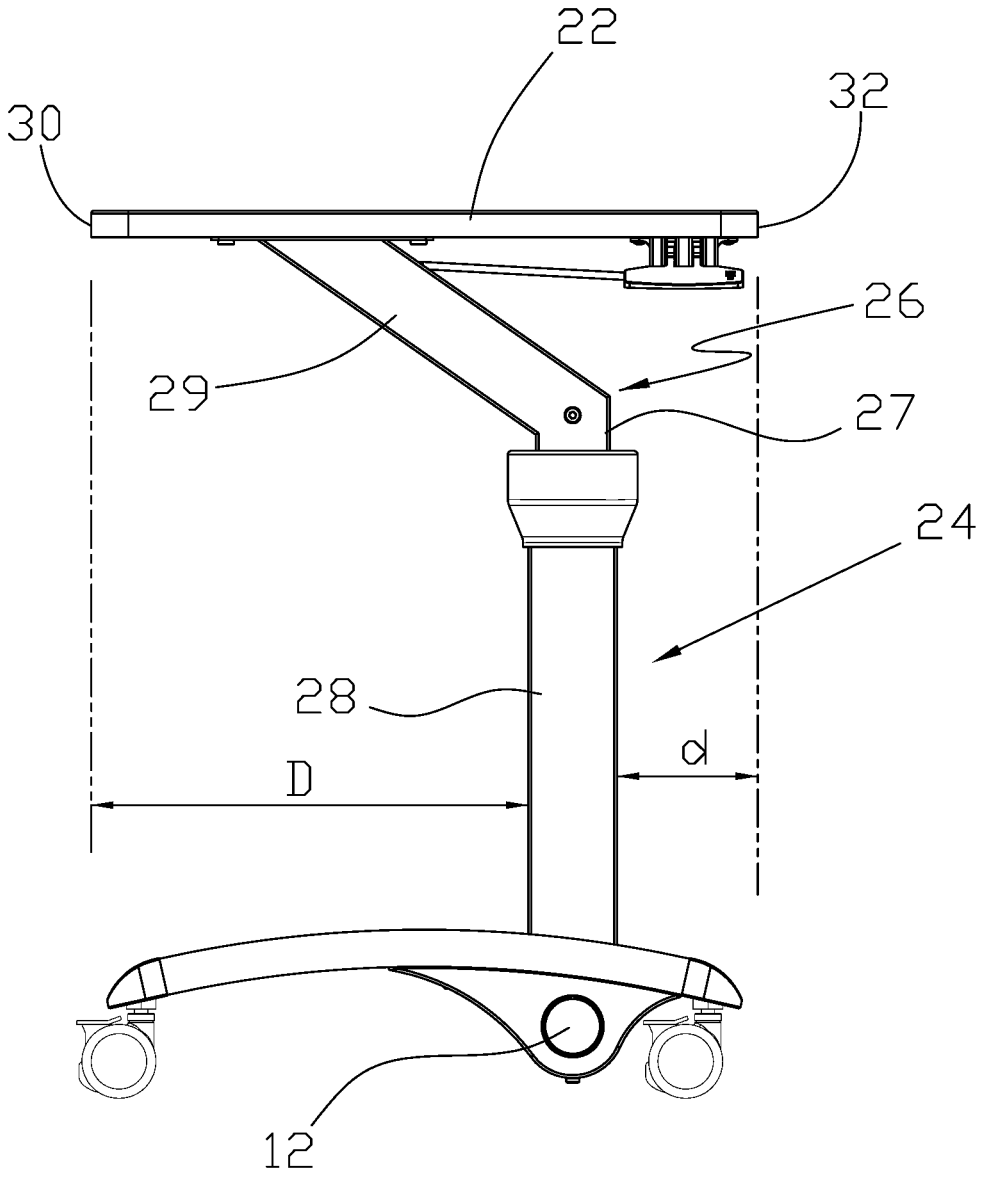
FIG. 2 is a right view of the preferred embodiment of the present invention, showing the work surface being lowered.
Figure 3:
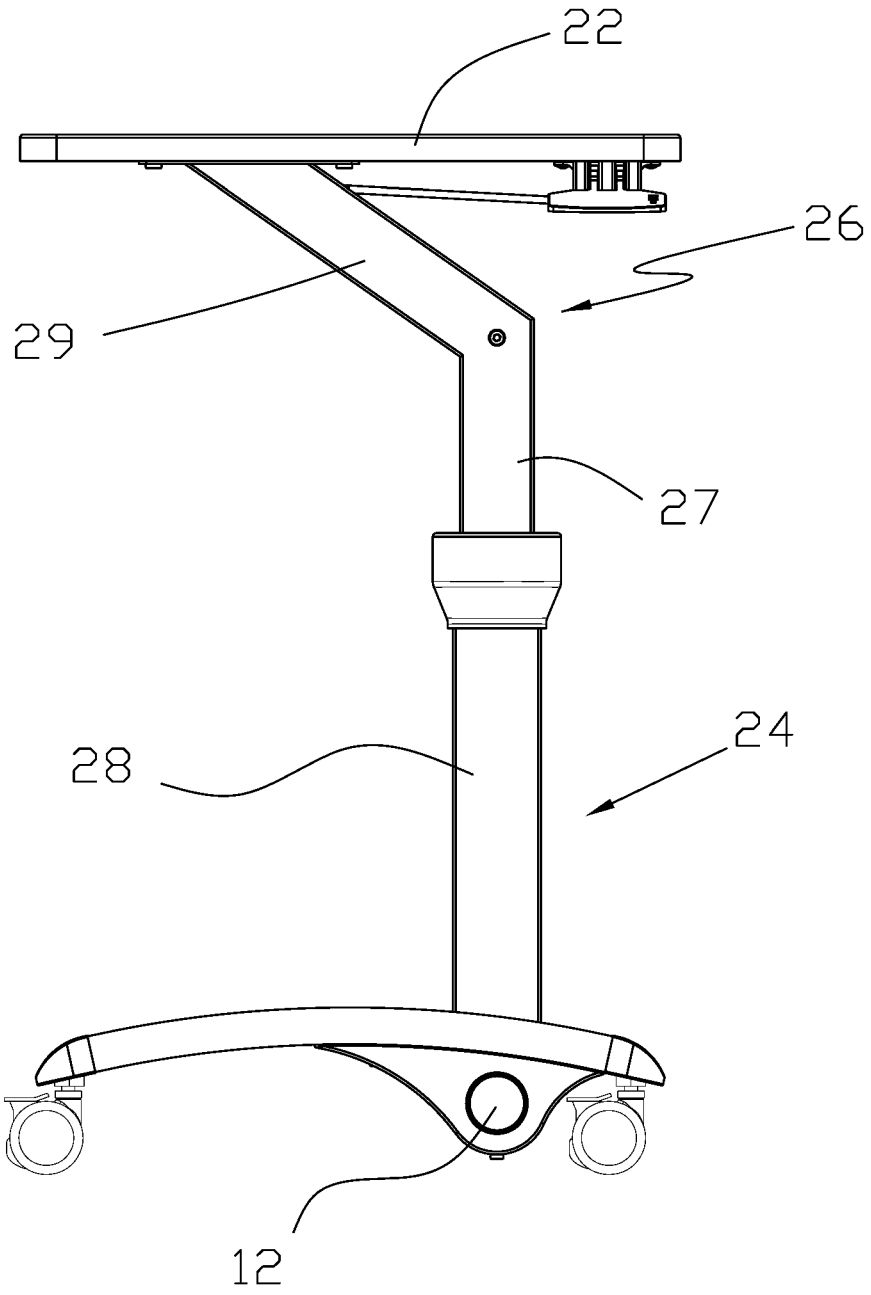
FIG. 3 is a right view of the preferred embodiment of the present invention, showing the work surface being lifted.

As shown in FIG. 2 and FIG. 3, the leg 24 has an inner tube 26, and the inner tube 26 has an inclined section 29 and a straight section 27. The leg 24 further has an outer tube 28, in which the straight section 27 of the inner tube 26 is inserted. The inner tube 26 is controllable to be moved relative to the outer tube 28. The inclined section 29 of the inner tube 26 is left out of the outer tube 28 and connected to a bottom of the board 22. In an embodiment, a pneumatic device (not shown) is mounted in the leg 24, so that the combination of the inner and the outer tubes 26, 28 and the pneumatic device work as a gas spring to lift or lower the board 22. It is noted that the board 22 may be lifted and lowered by manual operation or by electrical control.

As shown in FIG. 2, the board 22 has a first end 30 and a second end 32 opposite to the first end 30. A distance (d) between the second end 32 and the outer tube 28 (or the straight section) is greater than a distance (D) between the first end 30 and the outer tube 28 (or the straight section).

Figure 4:
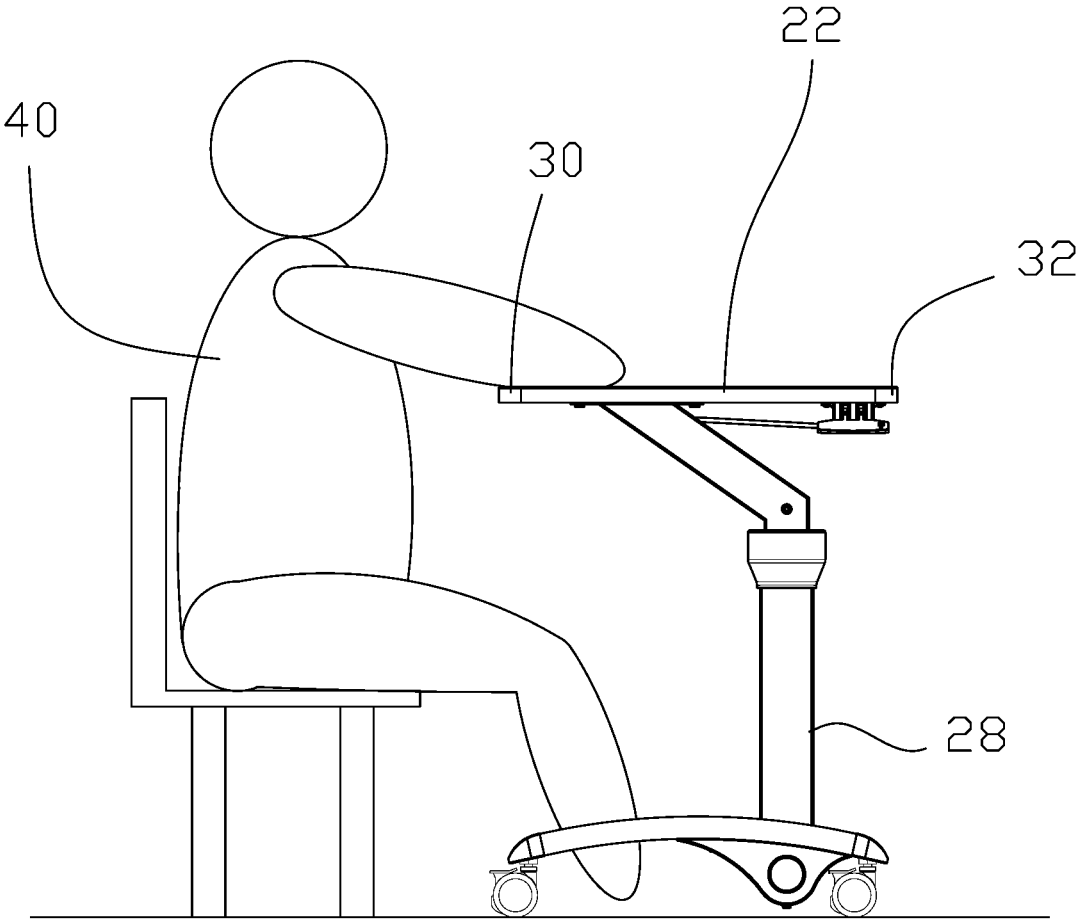
FIG. 4 is a sketch diagram of the preferred embodiment of the present invention, showing a person sitting by the desk.

As shown in FIG. 4, the first end 30 is designated to an end proximal to a person who sits by the desk of the present invention. Therefore, the desk of the present invention provides a large space under the board for legs of a person who sits by the desk. In addition, the inclined section 29 of the inner tube 26 is connected to a center of weight of the board, or close to the center of weight which provides the desk with a stable condition.

Figure 5:
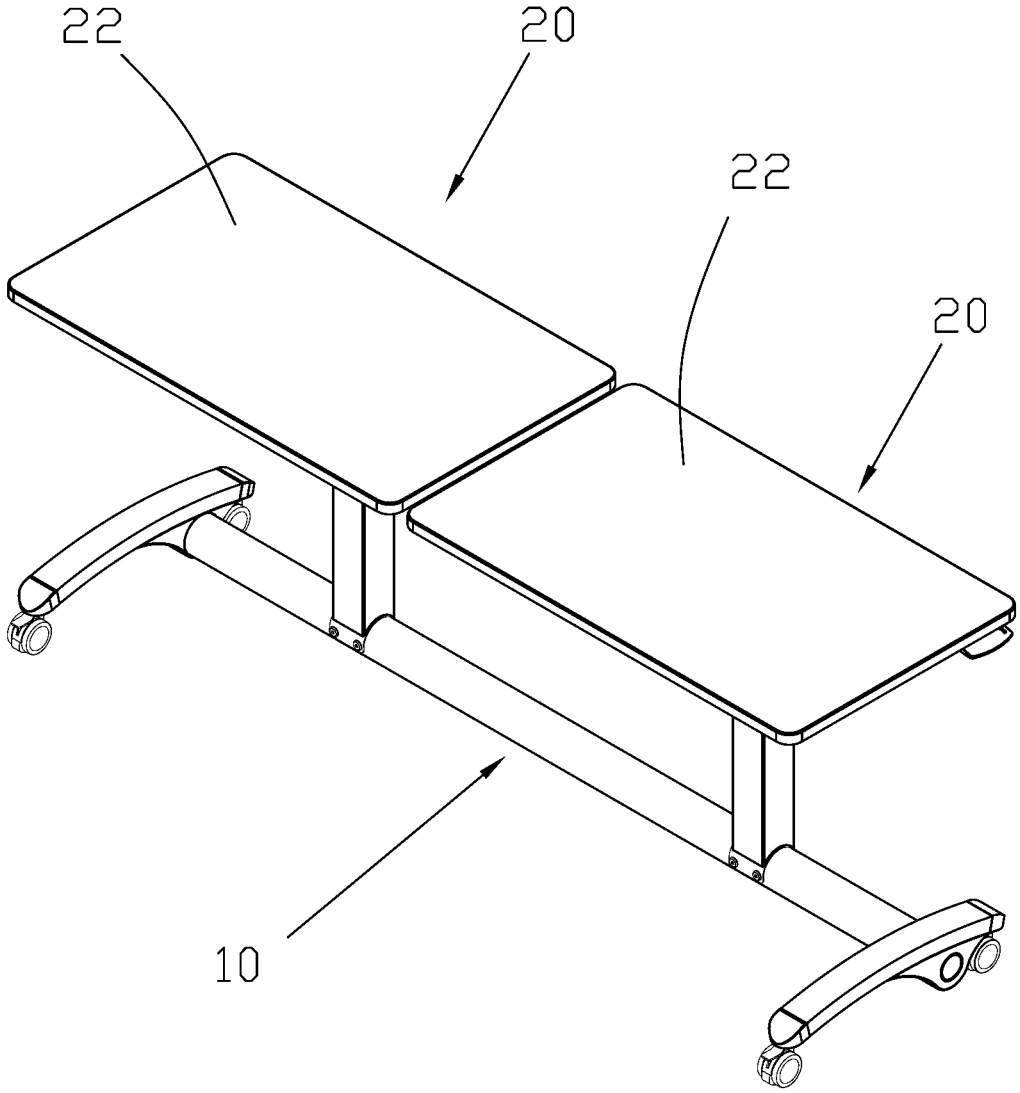
FIG. 5 is a perspective view of the preferred embodiment of the present invention, showing two work surface assemblies being mounted.
Figure 6:
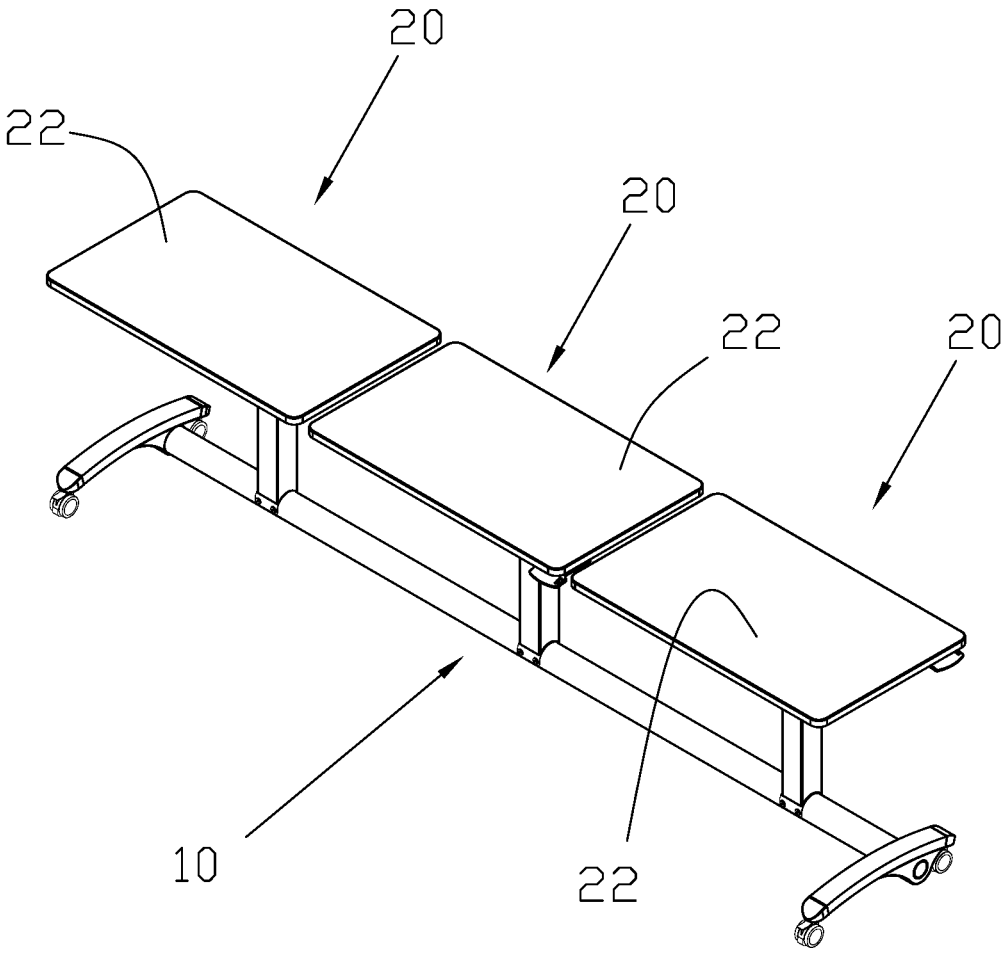
FIG. 6 is a perspective view of the preferred embodiment of the present invention, showing three work surface assemblies being mounted.
Figure 9:
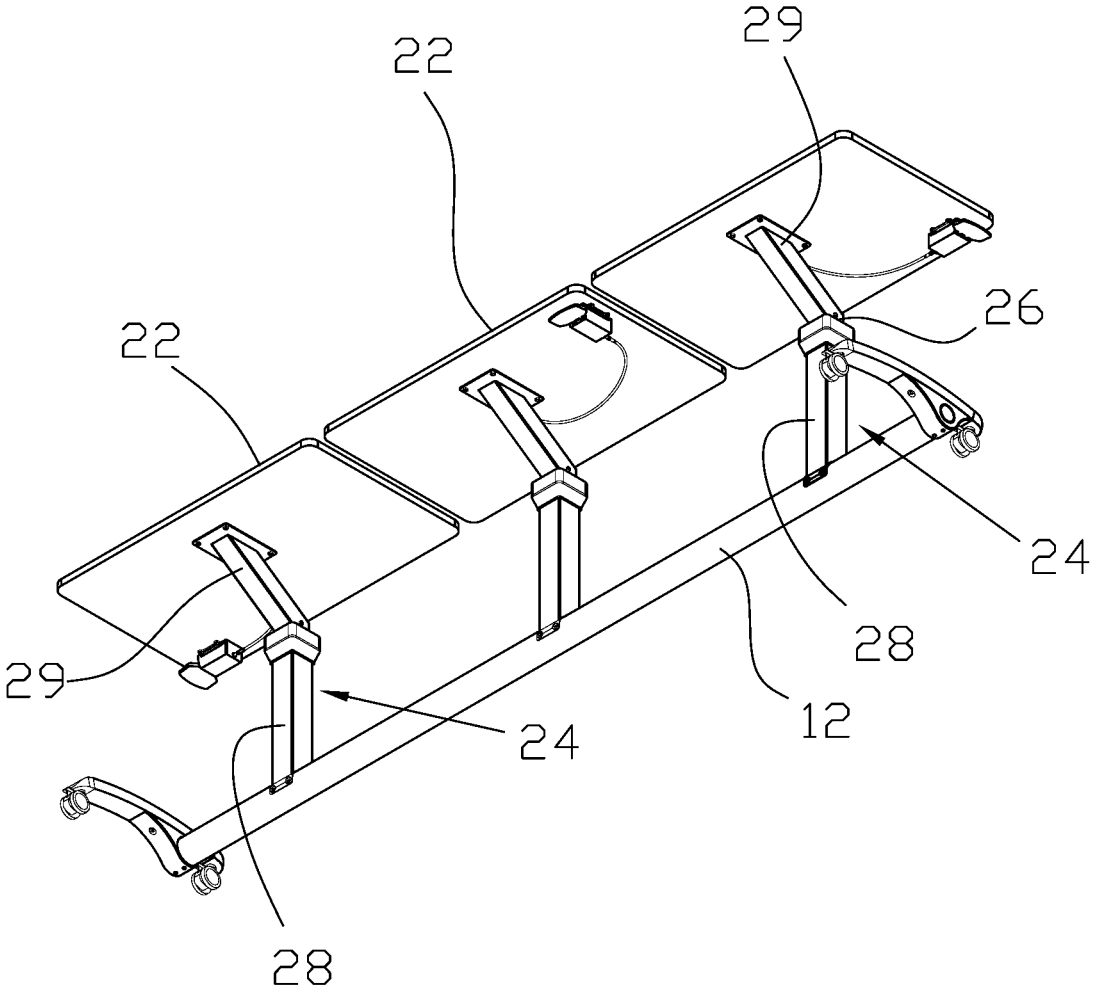
FIG. 9 is another perspective view of FIG. 6.

By changing the shaft 22, the desk of the present invention may be provided with a plurality of work surface assemblies 20. For example, FIG. 5 shows two work surface assemblies 20 are connected to the shaft 22 side by side, and FIG. 6 shows three work surface assemblies 20 are connected to the shaft 22 in a row. In this matter, the inclined sections 29 of the inner tubes 24 of the work surface assemblies 20 lean toward the same direction (referring to FIG. 9).

Figure 7:
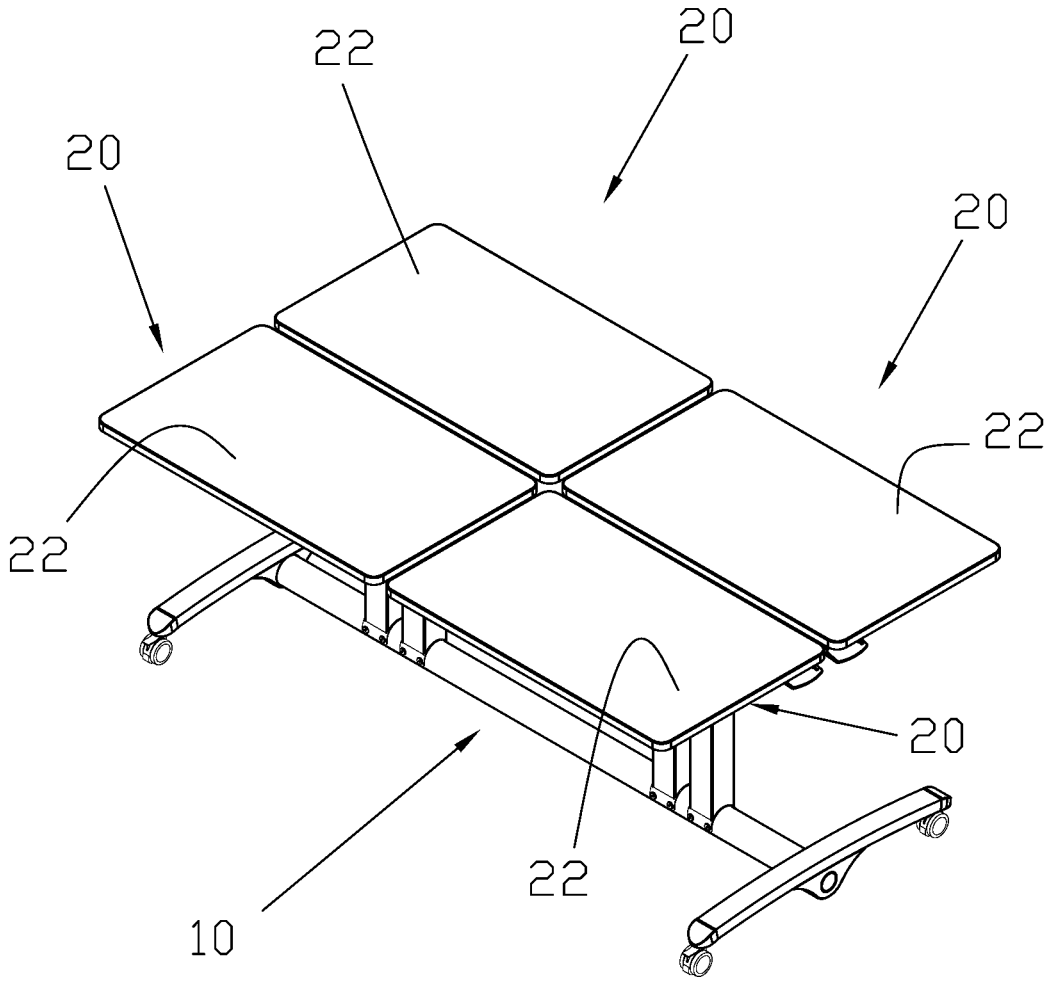
FIG. 7 is a perspective view of the preferred embodiment of the present invention, showing four work surface assemblies being mounted in a matrix.
Figure 8:
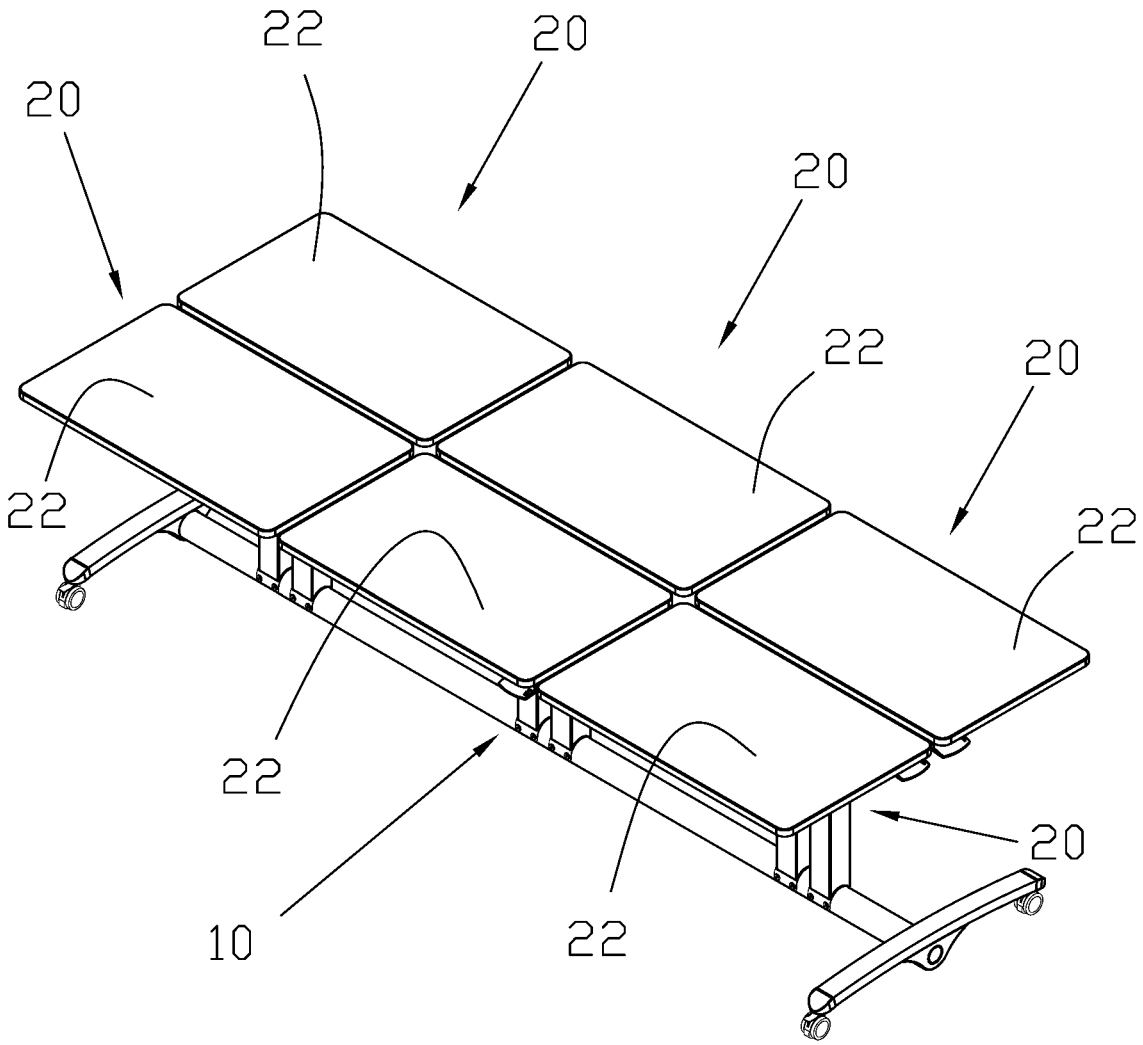
FIG. 8 is a perspective view of the preferred embodiment of the present invention, showing six work surface assemblies being mounted in a matrix.
Figure 10:
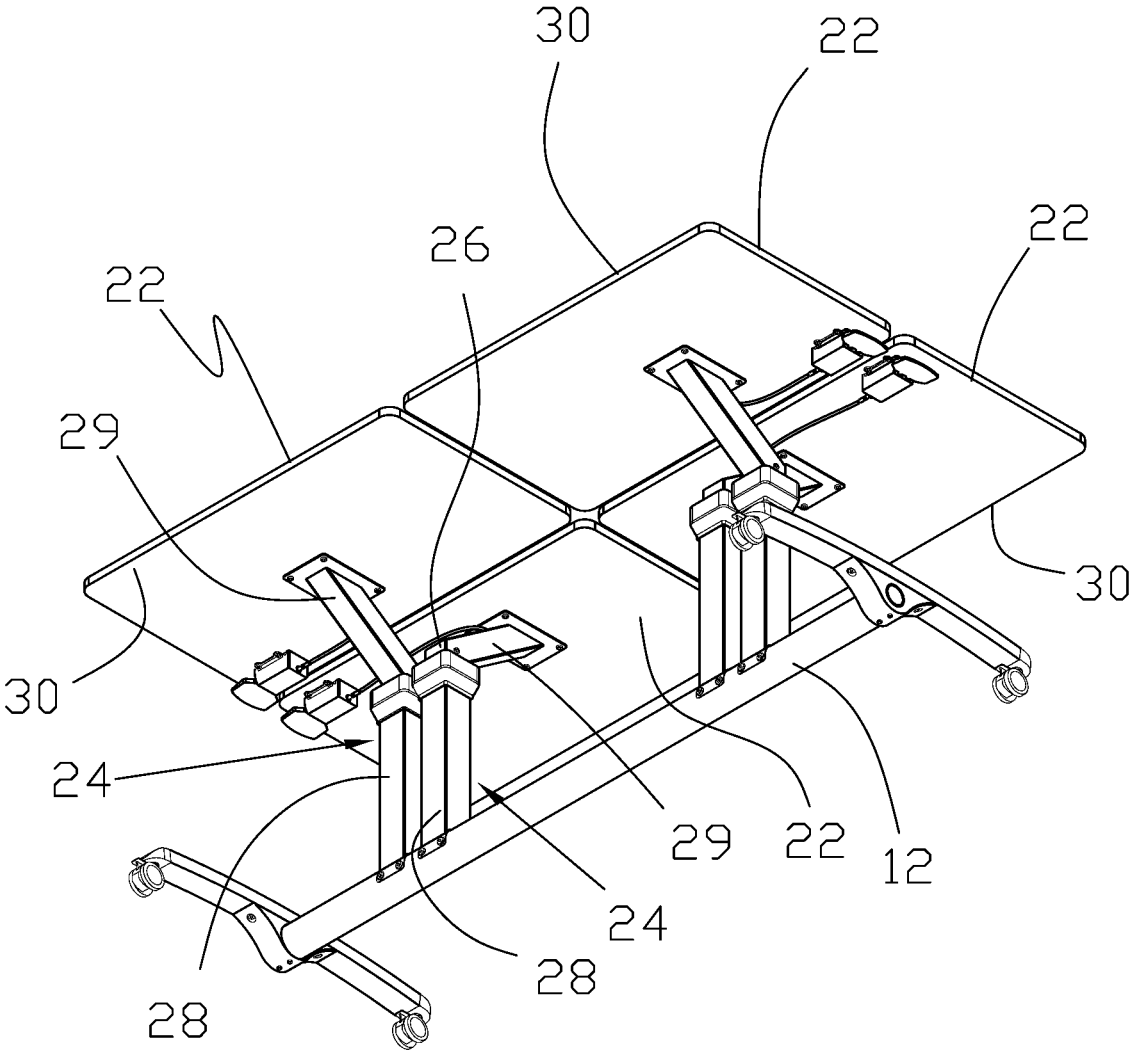
FIG. 10 is another perspective view of FIG. 7.

FIG. 7 and FIG. 8 show four and six work surface assemblies 20 are connected to the shaft 22 in two rows. The boards 22 in the same column lean to opposite directions, and the outer tubes 28 arranged in a row (referring to FIG. 10).

It is easy to understand that the present invention only provides a base, on which may mount one or more work surface assemblies in in a matrix of a row or two rows. It has a simple structure and takes less space. The height of the board 22 is adjustable to meet a height of a person who sits by the desk.

It must be pointed out that the embodiments described above are only some preferred embodiments of the present invention. All equivalent structures which employ the concepts disclosed in this specification and the appended claims should fall within the scope of the present invention.

What is claimed is:

1. A desk, comprising:

a base; and a plurality of work surface assemblies mounted on the base, wherein the work surface assemblies are arranged in a matrix;

wherein each of the work surface assemblies has a board and a leg having opposite ends connected to the board and the base, wherein the leg has an inclined section and a straight section, and the board has a first end and a second end opposite to the first end; further wherein a distance between the first end of the board and the straight section of the leg is greater than that of between the second end of the board and the straight section of the leg wherein the base has a shaft connected to the legs of the work surface assemblies and two stands connected to opposite ends of the shaft.

2. The desk of claim 1, wherein the leg of each of the work surface assemblies has an inner tube and an outer tube; the inner tube has the inclined section and the straight section, and the straight section is inserted into the outer tube, whereby the inner tube is controllable to be moved relative to the outer tube.

3. The desk of claim 1, wherein the inclined sections of the legs of the work surface assemblies lean to the same direction, so that the boards are arranged in a row.

4. The desk of claim 1, wherein the inclined sections of the legs of the work surface assemblies lean to opposite directions, so that the boards are arranged in two rows.

* * * * *